United States Patent [19]

Martt

[11] 4,179,913

[45] Dec. 25, 1979

[54] METAL STRIP TENSIONING APPARATUS FOR USE IN CONTINUOUS STRIP REDUCTION COLD MILL AND METHOD

[75] Inventor: Judson W. Martt, Amsterdam, Ohio

[73] Assignee: National Steel Corporation, Pittsburgh, Pa.

[21] Appl. No.: 873,364

[22] Filed: Jan. 30, 1978

Related U.S. Application Data

[62] Division of Ser. No. 737,019, Oct. 29, 1976, Pat. No. 4,086,689.

[51] Int. Cl.[2] ..... B21B 1/28

[52] U.S. Cl. ..... 72/205; 72/10; 72/227; 226/21

[58] Field of Search ..... 29/33 B; 72/10, 12, 72/227, 205, 250, 183, 234, 205; 226/21, 22, 23

[56] References Cited

U.S. PATENT DOCUMENTS

| | | | |
|---|---|---|---|
| 2,074,873 | 3/1937 | Tytus et al. | 72/205 X |
| 2,105,736 | 1/1938 | Hudson | 72/205 X |
| 2,155,860 | 4/1939 | Hudson | 72/234 X |
| 3,039,513 | 6/1962 | Lasiewicz et al. | 72/205 |
| 3,453,847 | 7/1969 | Romanauskas | 72/205 |
| 3,835,681 | 9/1974 | Shumaker | 72/10 |

*Primary Examiner*—Milton S. Mehr
*Attorney, Agent, or Firm*—Shanley, O'Neil and Baker

[57] ABSTRACT

Metal strip tensioning apparatus for use in a continuous cold reduction method and mill for metal strip in which the trailing end of a metal strip passing through the mill is welded to the leading end of a metal strip coming off a new coil without stopping the mill, the trailing end portion of the metal strip passing through the mill being paid out from a metal strip storage system during the welding operation with a resulting loss of close control of the lateral metal strip position at the entry side of the first mill stand, the present invention providing a method and means associated with a metal strip back tensioning unit ahead of the first mill stand for correcting the lateral position of the metal strip issuing from the metal strip storage system while applying the tension of the metal strip in the metal strip storage system to the metal strip entry side of the back tensioning unit. The metal strip back tensioning unit serves the dual function of placing metal elongation tension on the metal strip going to the first mill stand while closely controlling the centering of the metal strip in the first mill stand.

30 Claims, 8 Drawing Figures

METAL STRIP TENSIONING APPARATUS FOR USE IN CONTINUOUS STRIP REDUCTION COLD MILL AND METHOD

This is a division, of application Ser No. 737,019, now U.S. Pat. No. 4,086,689, filed Oct. 29, 1976, the entire disclosure of which is incorporated herein by reference.

BACKGROUND OF THE INVENTION

With the introduction of the continuous cold reduction strip metal mill in which the trailing end portions of a strip moving through the mill is welded to the leading end portion of a strip being led off a new coil, which operation requires a strip storage system for the trailing end portion of the strip in the mill in order to keep the mill running while the weld is made, the previous close control of the lateral position of the strip entering the cold mill from a back tensioning strip pay-off reel was lost. This is especially the case because all hot rolled strip being fed to cold reduction mills has some camber, most notably at the leading end portion of the strip, and this camber results in the strip leaving the strip storage system being off center relative to the center line of the mill.

Prior to applicant's invention, this difficulty was remedied by passing the strip from the strip storage system into a looping pit where no tension is present in the strip and as the strip comes out of the looping pit, edge guides can steer the moving strip into centered position relative to the center line of the mill. However, this arrangement has the fault that the strip entering the first mill stand back tensioning unit has no appreciable tension on it and since tensioning units used in cold reduction mills merely multiply the tension on the strip entering them, the strip going from the back tensioning unit to the first mill stand in such case cannot be at the tension necessary for a satisfactory percentage of cold reduction in the first mill stand. As is well known, in cold reducing metal strip, the cold reduction operation in each mill stand results from a combination of the crushing force of the work rolls and the elongating force of the tension on the strip. Therefore the remedy for the off center strip difficulty in a cold reduction mill prior to the applicant's invention, necessarily resulted in a first mill stand which could not perform the desired percentage of cold reduction expected from each mill stand and instead of having, for example, a five stand mill, the over all effect was to have a four stand mill.

Additionally, edge guides necessary with the prior arrangement often damage the edges of the strip and are themselves, being formed of brass or the like, cut and grooved by the strip. The former fault means damaged product unsaleable without edge shearing and the latter means appreciable maintenance costs.

Applicant has eliminated these problems and has provided a continuous cold reduction metal strip mill in which all the mill stands perform desired percentages of cold reduction. This has been accomplished by maintaining the strip issuing from the strip storage system at the desired high speed strip handling tension, omitting the looping pit and taking the taut strip metal directly from the strip storage system into the back tensioning unit ahead of the first mill stand. Since the strip metal may be off center relative to the center line of the mill as the strip comes from the strip storage system, applicant has provided means for pivotal movement of the back tensioning unit around a vertical axis (such device being herein sometimes referred to as a pivoting, running strip gripping means) to thereby align the entering strip with the center line of the mill. A laser beam strip tracking device between the back tensioning unit and the first mill stand can be utilized to supply signals to power means for actuating the pivotal movement of the back tensioning unit to maintain the strip entering the first mill stand centered.

Although this invention is applicable to all metals which are cold reduced under elongation tension, it will be described in the environment of the steel industry.

SUMMARY OF THE INVENTION

The present invention involves a metal strip tensioning apparatus comprising a plurality of metal strip engaging rolls for successive engagement with the metal strip, the plurality of rolls including a first roll relative to engagement with the metal strip, an intermediate roll and a final roll relative to engagement with the metal strip, the axes of rotation of the rolls being parallel and being disposed so that the metal strip engages more than 180° of the peripheral surface of the intermediate roll, a roll supporting framework structure including journals on each side of the frame work supporting the metal strip engaging rolls for rotation, drag generator means operatively connected to at least the intermediate strip engaging roll to apply to the intermediate strip engaging roll a desired torque resistance to rotation of the strip engaging roll by the strip, a stationary base structure for anchorage to a foundation, vertical pivot means carried by the stationary base structure, vertical pivot means carried by the roll supporting framework structure coacting with the vertical pivot means of the stationary base structure for pivotally mounting the roll supporting framework structure relative to the stationary base structure, a plurality of roller means and coacting roller bearing surface means spaced from one another in a horizontal plane carried by the base structure and the framework means, each of the roller means and the vertical pivot means being spaced apart from one another in a horizontal plane, the roller means and the roller bearing surface means acting to form a plurality of rolling support points between the framework and the base structure, and power means acting between the stationary base structure and the framework structure to pivot the framework structure around the pivot means.

Another aspect of the present invention involves the method of continuously reducing metal strip running through a continuous cold reduction mill comprising uncoiling strip alternately from a plurality of uncoilers, welding the trailing end of the metal strip running through the cold reduction mill to the leading end of the metal strip coming off an uncoiler, accumulating a length of running metal strip while maintaining the accumulated metal strip under high speed strip handling tension so that the metal strip from the accumulated metal strip can be continuously fed into the first cold reduction mill stand of the mill while a weld is being made, the first mill stand having a center line relative to strip movement through the mill stand and including a pair of work rolls for exerting cold reduction pressure on the strip as it passes between the work rolls, applying back tensioning force to the running metal strip at a point ahead of the first mill stand while maintaining the accumulated running metal strip under the high speed strip handling tension, the back tensioning force applied to the running metal strip at the point ahead of the first cold reduction mill stand being great enough to cause metal strip elongation in the running metal strip passing between the work rolls of the first cold reduction mill stand, and while applying the back tensioning force to the running metal strip at the point ahead of the first cold reduction mill stand applying lateral force to the running metal strip by twisting the running metal strip when necessary to assure that the center line of the running metal strip coincides with the center line of the first cold reduction mill stand.

DETAILED DESCRIPTION OF THE PREFERRED EMBODIMENT OF THE PRESENT INVENTION

Figure 1:
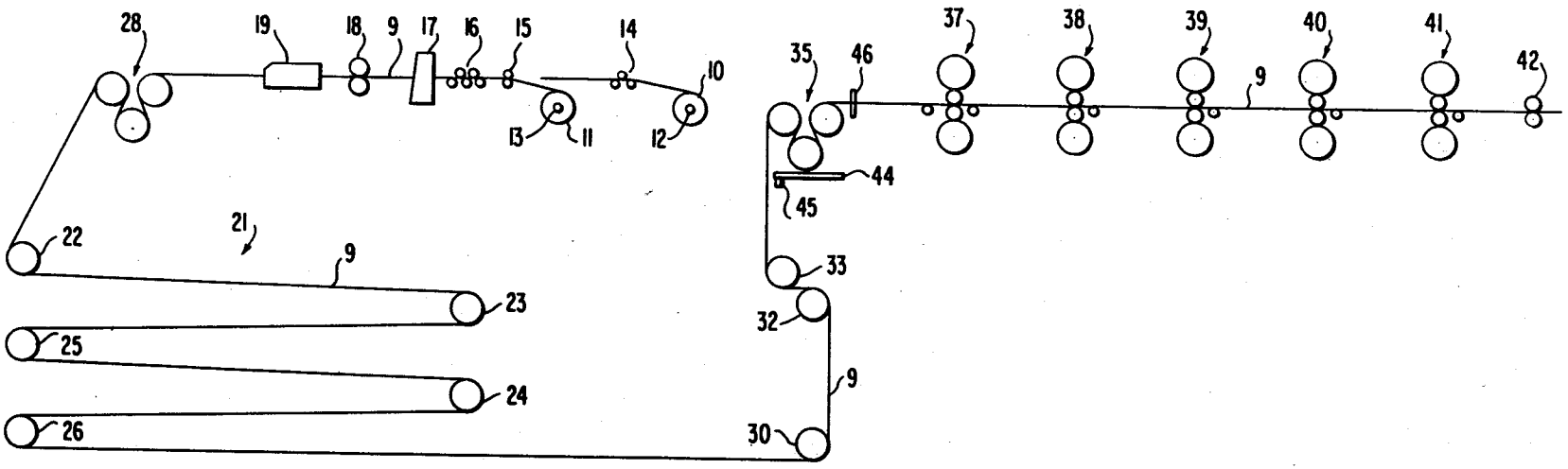
FIG. 1 is a diagrammatic showing of the strip entry end of a cold reduction mill for carrying out the method of and incorporating the present invention.

Referring to FIG. 1, the continuous cold reduction mill for steel strip which is diagrammatically shown from the uncoilers through the five four-high mill stands comprises metal strip handling equipment providing for alternately uncoiling steel strip 9 from coil 10 or 11, the coils being held on payoff reels 12 and 13, the strip from pay-off reel 12 going through a three roll straightener 14 and the strip from pay-off reel 13 going through pinch rolls 15. Whichever strip end is starting into the line is flattened in leveler 16 (which at other times remains open and inoperative) and its leading end sheared in squaring shear 17 from whence it is directed through pinch rolls 18 into welder 19 where the tail end of the preceding strip is being held, after having been squared in shear 17, and the two strip ends are welded together.

A looper or strip storage system is indicated generally at 21 and comprises a deflector roll 22 and stationary guide rolls 23 and 24. Guide rolls 25 and 26 are mounted on loop cars, not shown, which travel toward and away from stationary rolls 23 and 24 so that a length of running strip 9 passing around and between the rolls can be accumulated in the looper while the intermediate portion of the strip on a coil is running through the cold mill, in order that there will be strip available to be paid out of the looper during the welding operation so as to keep the mill running. A looper entry bridle or tensioning unit is indicated generally at 28, which tensioning unit serves to withdraw strip from the operating pay-off reel and maintain back tension on the strip in the looper. At the exit end of the looper a deflector roll 30 and tracking rolls 32 and 33 convey the strip to the entry side of the back tensioning unit or running strip gripping means, indicated generally at 35, ahead of the first mill stand where in coaction with tension unit 28 sufficient tension is maintained on the strip for handling the strip in the strip storage system at high speed. Tracking rolls 32, 33 assure that the strip at that point in the looper or strip storage system will have its center line within a fraction of an inch of the center line of the mill when the strip enters the back tensioning unit 35. However, accurate centering of the taut strip entering the first mill stand cannot be accomplished back at tracking rolls 32, 33 and it is for this reason that a slack loop and edge guides for the strip as close to the first mill stand as practicable have been used heretofore.

The successive mill stands of the mill are each indicated generally at 37, 38, 39, 40 and 41 respectively, these mill stands each being made up of the usual work rolls and back up rolls. After the last mill stand 41 and pinch rolls 42, not shown because it constitutes no part of the present invention, would be a pair of tension reels for coiling the strip and associated equipment for placing them alternately in operation.

Still considering FIG. 1, an important component of the present invention is entry bridle or back tensioning unit 35 carried on a platform, indicated diagrammatically at 44, which platform is diagrammatically indicated as being pivoted at 45 at its rear end relative to strip travel, thereby forming a pivoting, running strip gripping means. In addition to coacting with tensioning unit 28 to maintain strip handling tension on the strip between tensioning unit 28 and its own entry side, the primary purpose of back tensioning unit 35 involves the dual function of applying a backwardly directed strip elongation tension on the strip entering the first mill stand 37 while at the same time correcting for any departure of the center line of the strip leaving the back tensioning unit from the center line of the first mill stand 37. Strip edge indicating means, such as a laser beam arrangement indicated generally at 46, controls apparatus (not shown) which actuates the strip centering action of back tensioning unit 35.

Entry bridles or back tensioning units have not been used in the past in connection with cold reduction mills for steel strip because the necessary elongating tension for the first mill stand was supplied by a drag generator connected to the uncoiler or pay-off reel. With the introduction of the continuous cold reduction steel strip mills, there being only two in the world at this time, the provision of some kind of a back tensioning means ahead of the first mill stand became essential because of the necessity for the strip storage system, indicated at 21 in the present disclosure. Back tensioning units had been used in many kinds of strip treating lines in the steel industry because handling steel strip at high speeds requires a taut line and therefore appreciable back tension on the strip. However the tensioning forces previously used were not in the same category as those necessary to apply elongation forces to steel strip going through a mill stand. It follows that in order to fully utilize the first mill stand to carry out a desired percentage of reduction, the back tensioning unit 35 in the present invention must be able to multiply the appreciable tension on the strip coming from the looper or strip storage system many times and must therefore be of a form wherein the strip engaging rolls have axes of rotation which are parallel and staggered in the direction of strip movement so as to achieve considerable strip wrap-around in respect to at least the center roll or an intermediate roll or rolls to prevent strip slippage in the unit. Thus a heavy structural framework must be supplied for the rotational support of the strip engaging rolls which can handle the tremendous forces present.

Reference is now made to FIGS. 2 to 8 which specifically disclose the structural details of a preferred embodiment of back tensioning unit 35.

This unit is made up of several important component parts, namely: a stationary base structure indicated generally at 50; a framework structure, indicated generally at 52, for rotatably mounting the strip engaging rolls; a pivot structure acting between base 50 and framework structure 52, indicated generally at 54; a pair of rolling supports acting between the rear of the framework and the base, indicated generally at 55; a pair of rolling supports, indicated generally at 56, acting between the forward end of the framework and the base; power means, indicated generally at 58, for actuating pivotal or pivoting movement of the framework; foundation supported drag generators connected to the strip engaging rolls, indicated generally at 60; and the strip edge indicating device 46 for controlling power means 58.

It will be apparent from the description so far that framework 52 which holds the rolls in parallel axial relation to each other is pivotally mounted relative to base 50 and because of the tremendous forces exerted on the strip between the tensioning unit and the first mill stand, provision has been made to support the framework by a vertical pivot structure which can resist the tension in the strip and by rolling contacts between the framework and the base which can support the weight of the tensioning unit and resist the vertical components of the strip tension which result from the framework being pivotally anchored at its rear at 54, these vertical forces being upwardly directed at the rear of the framework and downwardly directed at the front of the framework. Thus rolling contacts 55 and 56 must handle the downward moment of force exerted on the forward or mill stand side of the framework and the upward moment of force exerted on the rearward or looper side of the tensioning unit.

Referring to FIGS, 2, 3, 5 and 6, it will be seen that pivot structure 54, which is located in the vicinity of the point where strip 9 enters back tensioning unit 35, is made up of a pivot pin 65 rigidly mounted in base structure 50 and projecting upwardly into a bearing structure 66 carried by framework 52. Pin 65 pivotally mounts framework 52 in relation to base structure 50 by a bearing, indicated generally at 67, which includes ball bearing structure 68 for rotational movement of framework 52 about pin 65. A conventional grease retainer is diagrammatically indicated at 69. Pivot structure 54 constrains framework 52 to pivotal or swinging movement of a horizontal plane and against any other movement in a horizontal plane.

Figure 5:
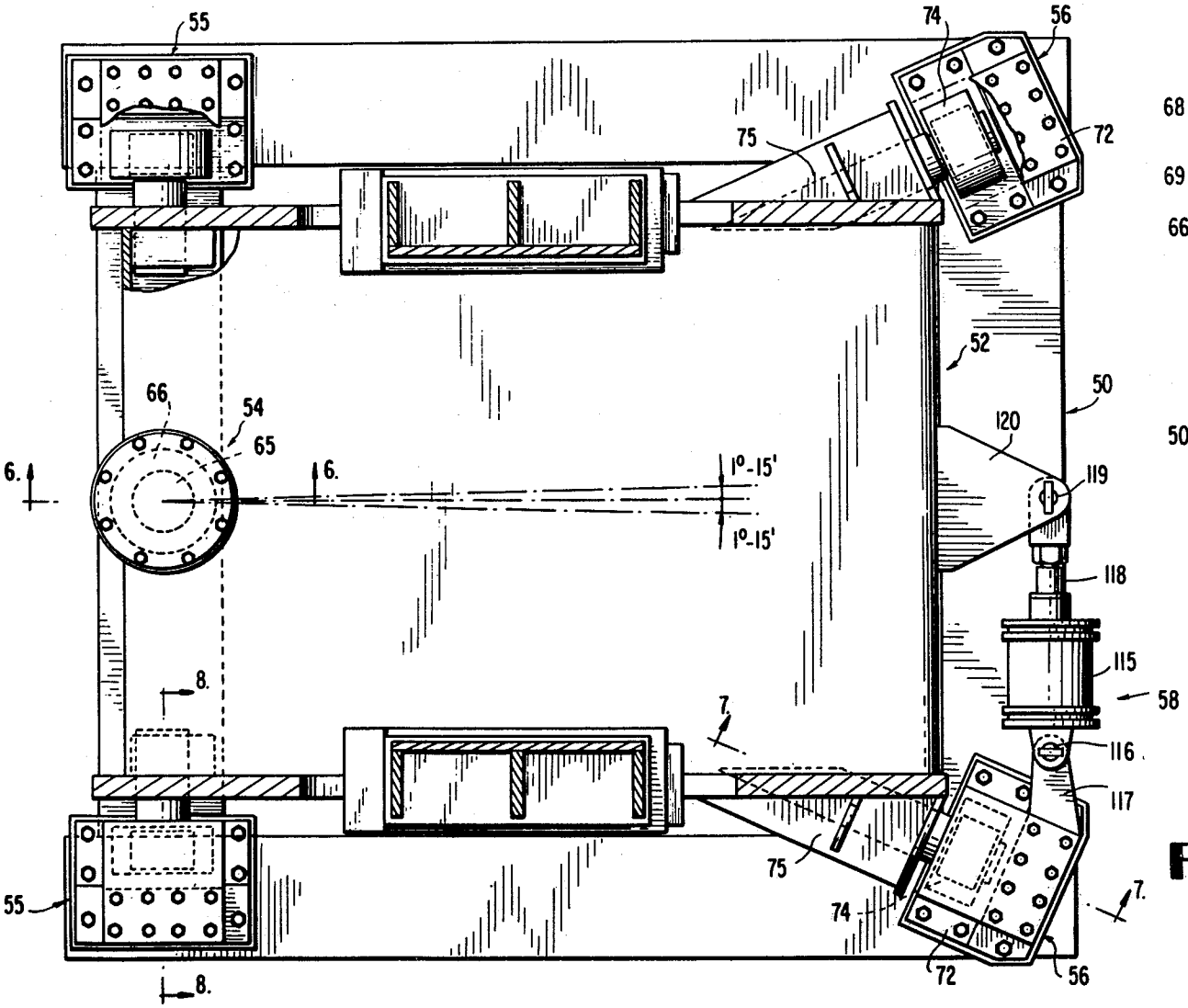
FIG. 5 is a view in horizontal section taken on the line 5—5 of FIG. 3.
Figure 7:
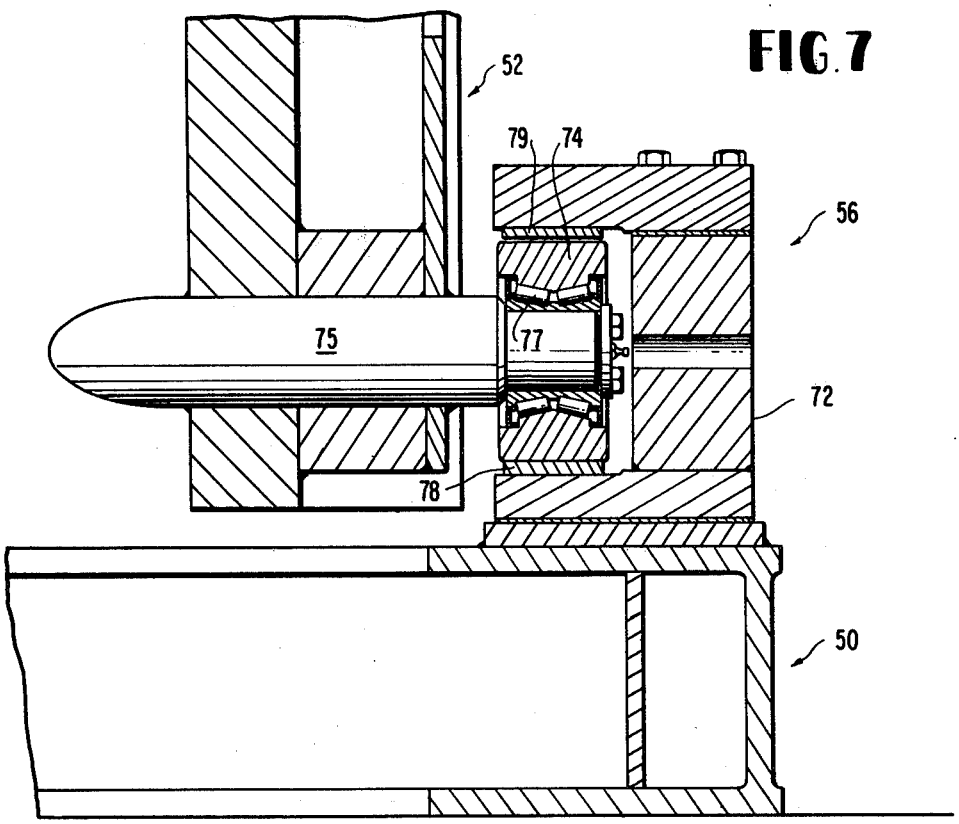
FIG. 7 is a fragmentary view in vertical section taken on the line 7—7 of FIG. 5.

Referring to FIGS. 5 and 7, at the forward end of the back tensioning unit 35, i.e. the side facing toward the first mill stand, framework 52 is held in spaced relation to base structure 50 and for limited pivotal or swinging movement by bearing blocks 72, 72 mounted on the base structure and rollers 74, 74 carried by outwardly projecting arms 75, 75 on the framework. It will be seen in FIG. 7 that each roller 74 is carried at the end of arm 75 by a roller bearing structure 77 which supports framework 52 for limited swinging movement. The axis of rotation of each roller 74 coincides with a straight line passing through the vertical axis of rotation of bearing structure 66. Each roller 74 rolls on lower bearing member or surface 78; a similar upper bearing member or surface 79 slightly spaced from the roller restrains the framework against bucking upwardly in case of strip breakage, these pads being rigidly held by bearing block 72.

Figure 8:
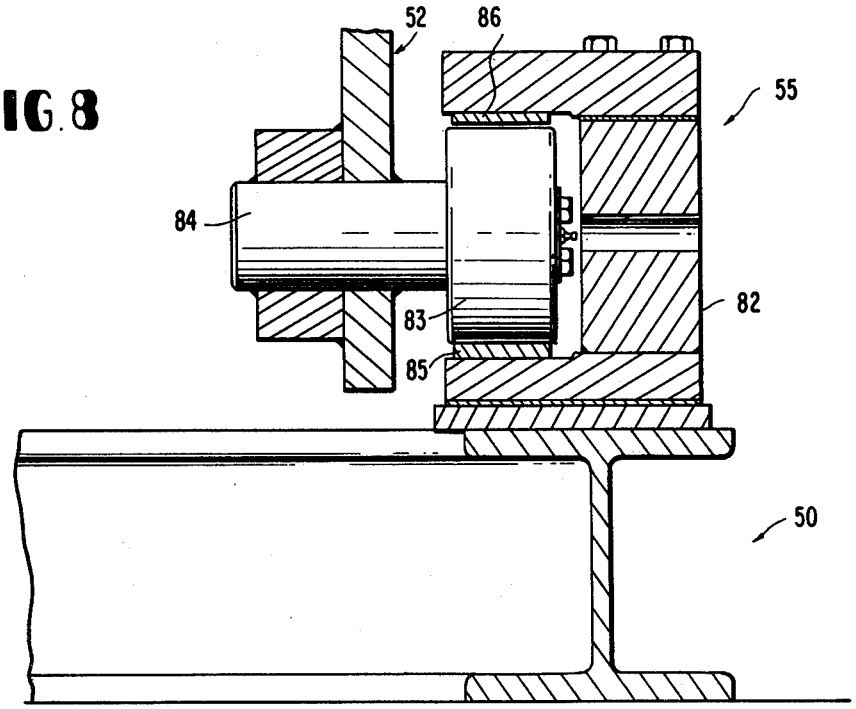
FIG. 8 is a fragementary view in vertical section taken on the line 8—8 of FIG. 5.

Referring to FIGS. 5 and 8, it will be seen that the swing roller bearing structures 55, 55 at the back of the tensioning unit, in addition to supporting the exceedingly heavy frame in spaced relation to the base structure, have provision for supporting the framework for a more limited swinging movement than that present at the forward end of the framework and also provide resistence to the framework being tilted forward by the tension on strip 9 between the back tensioning unit and the first mill stand. In respect to each of roller bearing structures 55, 55, a bearing block 82 supported by the base structure and roller 83 rotatably mounted on a spindle 84 rigidly carried by framework 52 provide a rolling support similar to each of supports 56 and bearing structures 55 have corresponding lower and upper bearing members or surfaces 85 and 86 and similar roller bearings not shown. The axis of rotation of each roller 83 coincides with a straight line through the vertical axis of rotation of bearing structure 66.

Referring for the moment back to FIG. 1, it will be seen that the bearing structures 54, 55 and 56 of tensioning unit 35 are subjected to three major forces; to wit, the weight of framework 52, the downward force due to the tension on the strip coming out of the strip storage system and the horizontal force of the back tension on the strip going to the first mill stand. Whatever the balance of these forces is at any given time during mill operation, the resistance of pivot structure 54 to movement of the framework in a horizontal plane and the bearing pads of rolling supports 55 and 56 will assure that framework 52, while pivotally mounted for slight swinging movement, will efficiently handle the changing forces.

Since the strip engaging rolls 96, 97 and 98 and their supporting journals generally correspond in structure and function to those used in most steel strip treating lines, although "heavied up", their structure will not be described in detail. Pressure roll structures indicated generally at 89 and 90 are movable away from the entrance and exit strip engaging rolls so that strip can be threaded through the tensioning unit and the pressure rolls are movable by the hydraulic jacks 91, 91 against the strip to press the strip against the strip engaging rolls. Strip guides 92, 92 (see FIGS. 2 and 3) assist in the strip threading operation.

Figure 2:
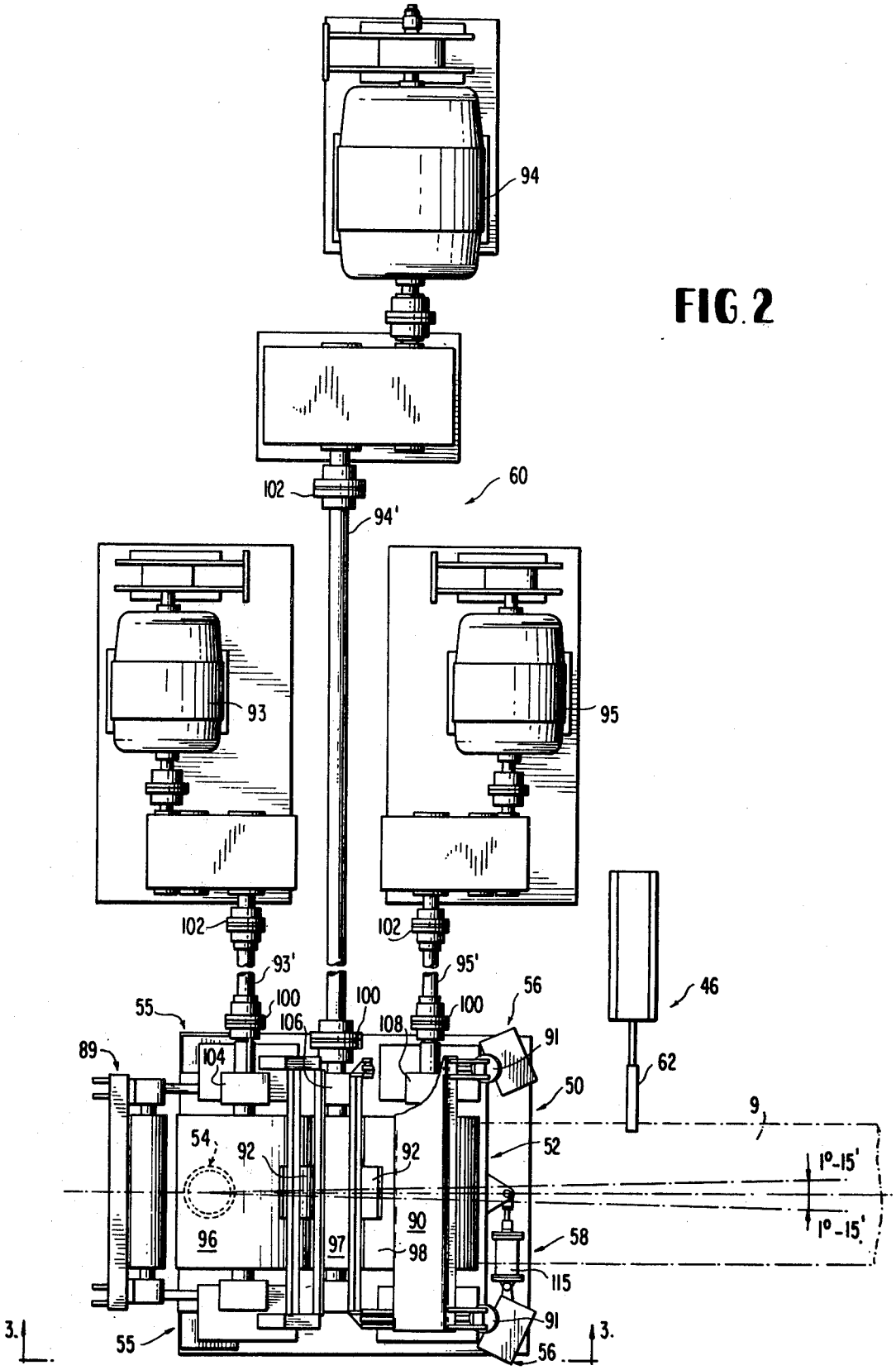
FIG. 2 is a plan view of the preferred embodiment of the entry bridle or back tensioning unit which forms an important component of the present invention.
Figure 3:
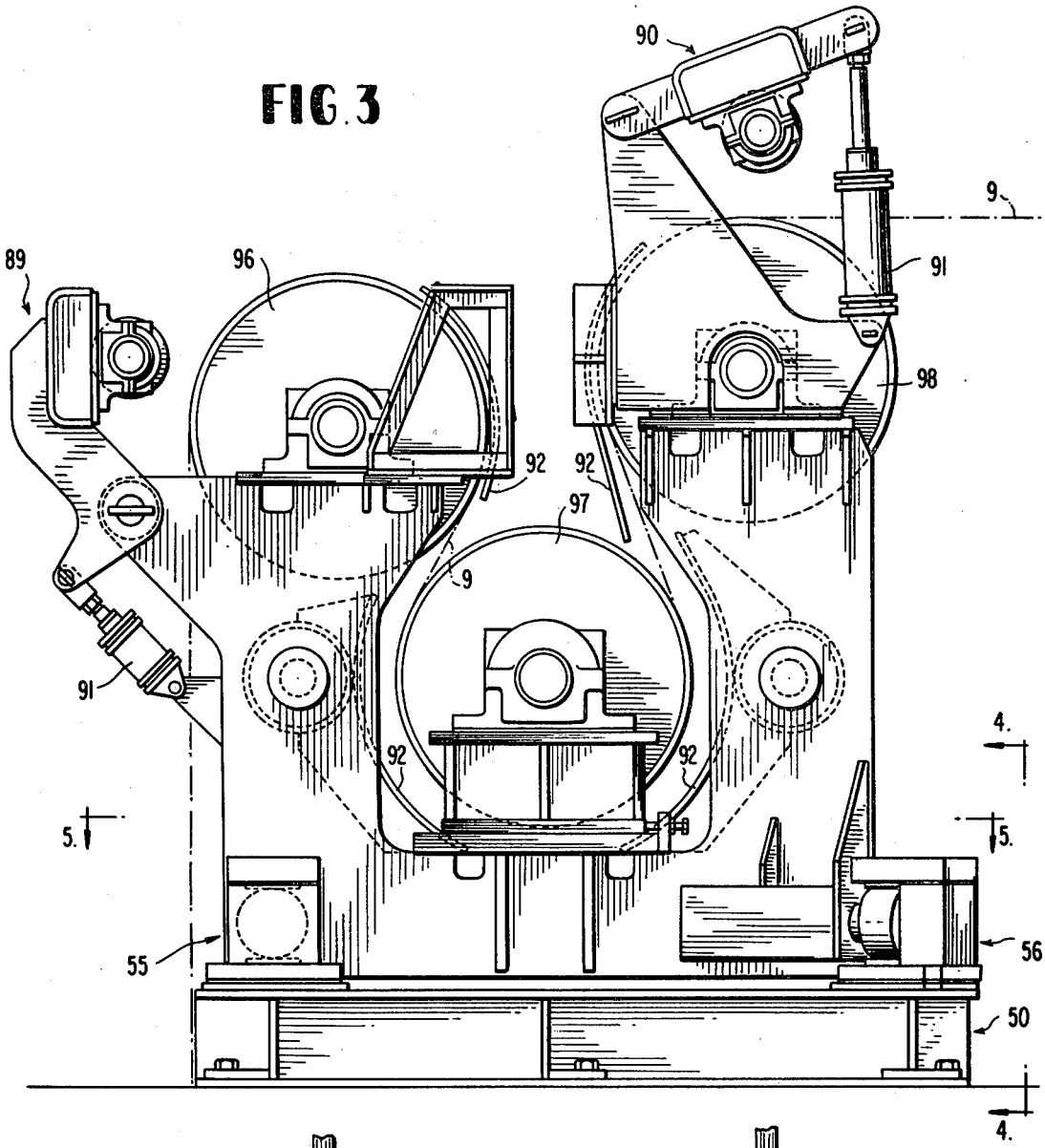
FIG. 3 is a view in side elevation of the back tensioning unit of FIG. 2.

Referring to FIG. 2, the drag generators 93, 94, 95 (already indicated generally at 60) and their associated gear boxes are connected by driving shafts 93', 94' and 95' to their respective strip engaging rolls 96, 97 and 98 through similar standard couplings 100, 100, 100 at the roll end of each shaft and similar standard couplings 102, 102, 102 at the generator end of each shaft. Since the generators are rigidly mounted relative to the foundations of the line and since the framework has limited pivotal or swinging movement, the connections between the shafts 93', 94' and 95' and their respective strip engaging rolls 96, 97 and 98 must accommodate such movement. Provision is made for this accommodation in special couplings 104, 106 and 108 located between standard couplings 100 and the respective strip engaging rolls 96, 97 and 98. Each of these special couplings is made up of two complementary end portions, one end connected to the associated generator shaft coupling 100 and the other end connected to the associated strip engaging roll shaft. Each end portion carries a plurality of rigid fingers or splines projecting toward the other end portion and spaced apart so as to receive therebetween the fingers or splines projecting from the other end portion. There is sufficient longitudinal and lateral play between these interfitting fingers to permit relative longitudinal movement and relative angular movement so that this structural relationship will accommodate the pivotal or swinging movement of the framework relative to the rigidly supported generators while transmitting torque from the strip engaging rolls to the drag generators.

It will be noted that generator 94 which is connected to the intermediate strip engaging roll 97 is much larger in size than the two generators connected to strip engaging rolls 96 and 98. The reason for this will be set out below.

Figure 4:
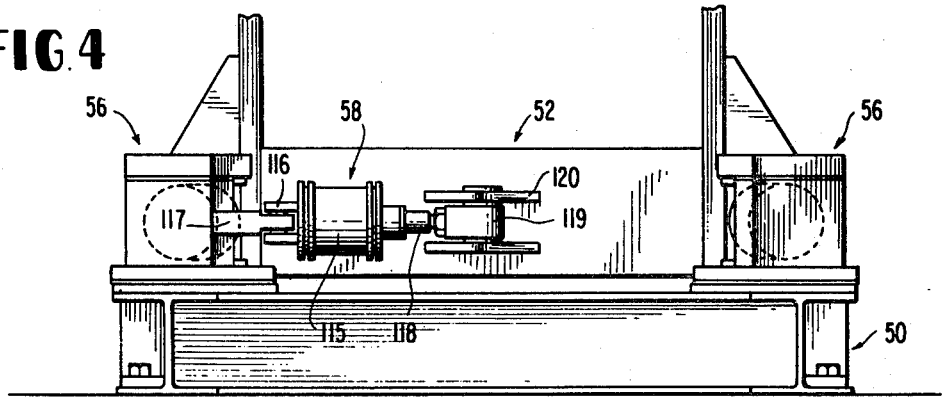
FIG. 4 is a fragmentary view in front elevation taken on the line 4—4 of FIG. 3.
Figure 6:
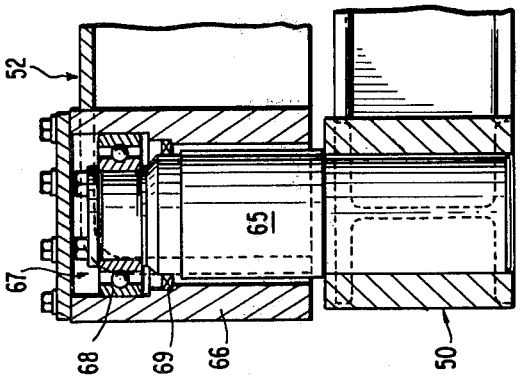
FIG. 6 is a fragmentary view in vertical section taken on the line 6—6 of FIG, 5.

Returning now to power means 58, as best seen in FIGS. 2, 4 and 5, a hydraulic cylinder 115 is pivotally connected at 116 to a lug rigidly carried by one of bearing blocks 56. A piston rod 118 reciprocated by a piston in cylinder 115 has its free end pivotally connected at 119 to a bifurcated bracket 120 carried by the framework 52 at the metal strip exit side of back tension unit 35. As already mentioned, the heavy tension existing in the steel strip between back tension unit 35 and the first mill stand requires that a component of the apparatus such as hydraulic cylinder 115 have considerable power. Hydraulic pressure lines to and from cylinder 115 (not shown) supply this power and the fluid flow in them is controlled from electrical signals emanating from strip edge detector 46. Strip edge detector 46 is a conventional piece of equipment which utilizes either a light source and photoelectric cell or a laser beam arrangement indicated at 62 for following the edge of the strip and by means of electrical circuits and signals indicating its location. This strip edge indicator has conventional means not shown for adjusting it to the width of the strip being reduced so that the position of the edge indicator will accurately indicate the location of the center line of the strip relative to the center line of the mill. As mentioned above, the signals emanating from edge detector 46 are utilized to control the action of power means 58 to control the pivotal movement of back tensioning unit 35 and thereby cause the strip to move laterally, where required, in the desired direction.

The operation of the preferred embodiment will now be described. The steel strip issuing from the looper 21 has its direction changed by deflector roll 30 and the strip then passes through a conventional steering roll combination 32, 33. This steering roll assembly can take any desired form of which there are numerous in the art, its purpose being to center the strip at that point relative to the center line of the mill as the strip approaches the entry side of back tensioning unit 35. Up to this latter point the strip is under appreciable tension which is necessary to control the strip at the high rolling speeds encountered. As the strip enters the back tensioning unit 35, its direction of movement is changed during its engagement with strip engaging roll 96 and at the same time drag generator 110 acting on roll 96 begins to build up back tension on the strip which is being pulled forward by work rolls of the first mill stand. In its engagement with roll 97, strip 9, because of its high degree of wrap around this roll and because of the great capacity of drag generator 94, has its back tension increased the major amount of that achieved in the entire back tension unit. The strip then engages roll 98 where additional tension force is applied to the strip and the direction is changed so that the direction of movement of the strip coincides with the mill pass line.

An important function of strip engaging rolls 96 and 98, in addition to their adding tension to the strip, is their positioning so as to wrap the strip around roll 97 through considerably more than 180°. In some situations, rolls equivalent to rolls 96 and 98 can have the primary purpose of changing the direction of strip movement to obtain a desired strip wrap around a roll such as roll 97 with one or neither of the change of direction rolls being connected to a generator and all the drag being applied to the roll which is the equivalent of roll 67. Of course in such case there must be the capability of multiplying tension on the strip to obtain the desired metal elongation tension. Obviously, more than three rolls and associated generators can be used in unit 35. In addition to the strip movement change in direction function of roll 98, there is the additional function that when the back tensioning unit pivots to maintain the center of the strip on the center line of the first mill stand, the strip 9 must move across the surface of roll 98 in the desired direction a lateral distance greater than in the case of the other strip engaging rolls. Because of this factor, the desired wrap around on roll 98 is the minimum consistent with obtaining the desired increase in strip tension and the desired wrap around on roll 97; thus the wrap around on roll 98 is preferably less than 180°. Of course the strip moves to some extent across the surface of all three rolls but the amount of this movement decreases in respect to each roll 97 and 96 in proportion to the distance toward pivot structure 54 backwardly along strip travel.

The steering roll assembly 32, 33 has operated to center the strip close (e.g. a quarter of an inch) to what should be its proper position farther along at the entry point of the first mill stand. Camber in the strip between roll 33 and strip position indicator 46 is compensated for in back tensioning unit 35 which in effect twists the strip to bring the center line of the strip into coincidence with the center line of the first mill stand. In carrying out this adjustment in the position of the strip in back tensioning unit 35, the strip has to travel laterally across the peripheral surface of roll 98. It is true that the lateral distances being discussed would seem to be minuscule, but in the presence of the tremendous tensional forces and high strip speeds involved they are of great practical importance.

It will be noted that pivot structure 54 of the back tensioning unit is at the rear of the unit, i.e. as near as practicable to the point where the strip enters the tensioning unit. Therefore, in correcting the path of strip 9 between the back tensioning unit and the first mill stand, the least pivotal or swinging movement of the strip engaging rolls of the unit is present in respect to roll 96 and the greatest amount of lateral movement takes place in respect to strip engaging roll 98, farthest from the pivot point. Assuming in FIG. 2, that the center of strip 9 is tending to move off the center line of the mill in the upward direction in this Figure, laser indicator 62 and strip position indicator 46 will act to cause power means 58 to move the framework around pivot structure 54 downwardly in the figure or in a clockwise direction. This tightens the strip on the lower side of roll 98 as seen in this figure which tends to cause the strip to move downwardly along roll 98, or in a sense to be twisted, and thus maintain the strip centered. Whether or not this theory of operation is correct, the apparatus of the present invention does compensate for camber in the strip and does maintain the strip centered in the first mill stand.

It will be clear that power means 58 in acting on the framework causes the framework to pivot around pivot structure 54 with rolling bearings 55 accommodating some movement and rolling bearings 56 acommodating greater movement since they are farther removed from the pivot point 54. It has been found that the degree of swing of the framework around pivot point 54 of one degree and 15 minutes is the maximum required in a mill for rolling steel strip about 48" or 50| wide and will give about 4½" of overall movement of the strip or 2¼" on each side of the center line.

The described embodiments are to be considered in all respects as illustrative and not restrictive since the invention may be embodied in other specific forms without departing from its spirit or essential characteristics. Therefore the scope of the invention is indicated by the claims rather than by the foregoing description, and all changes which come within the meaning and range of the equivalents of the claims are intended to be embraced therein.

I claim:

1. A metal strip tensioning apparatus comprising a plurality of metal strip engaging rolls for successive engagement with the metal strip, the plurality of rolls including a first roll relative to engagement with the metal strip, an intermediate roll and a final roll relative to engagement with the metal strip, the axes of rotation of the rolls being parallel and being disposed so that the metal strip engages more than 180° of the peripheral surface of the intermediate roll, a roll supporting framework structure including journals on each side of the framework supporting the metal strip engaging rolls for rotation, drag generator means operatively connected to at least the intermediate strip engaging roll to apply to the intermediate strip engaging roll a desired torque resistance to rotation of the strip engaging roll by the strip, a stationary base structure for anchorage to a foundation, vertical pivot means carried by the stationary base structure, vertical pivot means carried by the roll supporting framework structure coacting with the vertical pivot means of the stationary base structure for pivotally mounting the roll supporting framework structure relative to the stationary base structure, a plurality of roller means and coacting roller bearing surface means spaced from one another in a horizontal plane carried by the base structure and the framework structure, each of the roller means and the vertical pivot means being spaced apart from one another in a horizontal plane, the roller means and the roller bearing surface means acting to form a plurality of rolling support points between the framework and the base structure, and power means acting between the stationary base structure and the framework structure to pivot the framework structure around the pivot means.

2. The apparatus of claim 1 wherein the coacting roller bearing surface means includes a member below each roller means for supporting the framework in respect to downwardly directed forces and a member above each roller means for resisting upwardly directed forces on the framework.

3. The apparatus of claim 2 wherein the vertical pivot means is located adjacent the metal strip entrance side of the back tensioning unit, and two of the roller means are located one on each side of the framework at the strip exit side of the back tensioning unit.

4. The apparatus of claim 3 wherein the roller means at the strip exit side of the back tensioning unit are located outwardly of the sides of the framework with the axis of rotation of each such roller means coincident with a straight line passing through the axis of rotation of the vertical pivot means.

5. The apparatus of claim 4 wherein two of the roller means, one on each side of the framework, have their axes of rotation coincident with a straight line passing through the axis of rotation of the vertical pivot means.

6. The apparatus of claim 5 wherein the framework is supported entirely relative to vertically directed forces by the roller means and in spaced relation to the stationary base structure, the vertical pivot means acting to anchor the framework against all movement in a horizontal plane other than pivotal movement around the vertical axis of rotation.

7. The apparatus of claim 6 wherein the power means is located at the metal strip exit side of the back tensioning unit.

8. The apparatus of claim 7 wherein the strip engaging roll arrangement causes the strip to make more than 180° of peripheral contact with the intermediate strip engaging roll and the drag generator connected to the intermediate strip engaging roll has a larger capacity than the remaining drag generators.

9. The apparatus of claim 1 wherein the vertical pivot means is located adjacent the metal strip entrance side of the back tensioning unit, and two of the roller means are located one on each side of the framework at the strip exit side of the back tensioning unit.

10. The apparatus of claim 9 wherein the roller means at the strip exit side of the back tensioning unit are located outwardly of the sides of the framework with the axis of rotation of each such roller means coincident with a straight line passing through the axis of rotation of the vertical pivot means.

11. The apparatus of claim 10 wherein two of the roller means, one on each side of the framework, have their axes of rotation coincident with a straight line passing through the axis of roation of the vertical pivot means.

12. The apparatus of claim 11 wherein the framework is supported entirely relative to vertically directed forces by the roller means and in spaced relation to the stationary base structure, the vertical pivot means acting to anchor the framework against all movement in a horizontal plane other than pivotal movement around the vertical axis of rotation.

13. The apparatus of claim 12 wherein the power means is located at the metal strip exit side of the back tensioning unit.

14. The apparatus of claim 13 wherein the strip engaging roll arrangement causes the strip to make more than 180° of peripheral contact with the intermediate strip engaging roll and the drag generator connected to the intermediate strip engaging roll has a larger capacity than the remaining drag generators.

15. The apparatus of claim 1 wherein the roller means at the strip exit side of the back tensioning unit are located outwardly of the sides of the framework with the axis of rotation of each such roller means coincident with a straight line passing through the axis of rotation of the vertical pivot means.

16. The apparatus of claim 15 wherein two of the roller means, one on each side of the framework, have their axes of rotation coincident with a straight line passing through the axis of rotation of the vertical pivot means.

17. The apparatus of claim 16 wherein the framework is supported entirely relative to vertically directed forces by the roller means and in spaced relation to the stationary base structure, the vertical pivot means acting to anchor the framework against all movement in a horizontal plane other than pivotal movement around the vertical axis of rotation.

18. The apparatus of claim 17 wherein the power means is located at the metal strip exit side of the back tensioning unit.

19. The apparatus of claim 18 wherein the strip engaging roll arrangement causes the strip to make more than 180° of peripheral contact with the intermediate strip engaging roll and the drag generator connected to the intermediate strip engaging roll has a larger capacity than the remaining drag generators.

20. The apparatus of claim 1 wherein two of the roller means, one on each side of the framework, have their axes of rotation coincident with a straight line passing through the axis of rotation of the vertical pivot means.

21. The apparatus of claim 20 wherein the framework is supported entirely relative to vertically directed forces by the roller means and in spaced relation to the stationary base structure, the vertical pivot means acting to anchor the framework against all movement in a horizontal plane other than pivotal movement around the vertical axis of rotation.

22. The apparatus of claim 21 wherein the power means is located at the metal strip exit side of the back tensioning unit.

23. The apparatus of claim 22 wherein the strip engaging roll arrangement causes the strip to make more than 180° of peripheral contact with the intermediate strip engaging roll and the drag generator connected to the intermediate strip engaging roll has a larger capacity than the remaining drag generators.

24. The apparatus of claim 1 wherein the framework is supported entirely relative to vertically directed forces by the roller means and in spaced relation to the stationary base structure, the vertical pivot means acting to anchor the framework against all movement in a horizontal plane other than pivotal movement around the vertical axis of rotation.

25. The apparatus of claim 24 wherein the power means is located at the metal strip exit side of the back tensioning unit.

26. The apparatus of claim 25 wherein the strip engaging roll arrangement causes the strip to make more than 180° of peripheral contact with the intermediate strip engaging roll and the drag generator connected to the intermediate strip engaging roll has a larger capacity than the remaining drag generators.

27. The apparatus of claim 1 wherein the power means is located at the metal strip exit side of the back tensioning unit.

28. The apparatus of claim 27 wherein the strip engaging roll arrangement causes the strip to make more than 180° of peripheral contact with the intermediate strip engaging roll and the drag generator connected to the intermediate strip engaging roll has a larger capacity than the remaining drag generators.

29. The apparatus of claim 1 wherein the strip engaging roll arrangement causes the strip to make more than 180° of peripheral contact with the intermediate strip engaging roll and the drag generator connected to the intermediate strip engaging roll has a larger capacity than the remaining drag generators.

30. The method of continuously reducing metal strip running through a horizontally disposed continuous cold reduction mill comprising uncoiling strip alternately from a plurality of uncoilers, welding the trailing end of metal strip running through the cold reduction mill to the leading end of the metal strip coming off an uncoiler, accumulating a length of running metal strip while maintaining the accumulated metal strip under high speed strip handling tension so that metal strip from the accumulated metal strip can be continuously fed into the first cold reduction mill stand of the mill while a weld is being made, the first mill stand having a center line relative to strip movement through the mill stand and including a pair of work rolls for exerting cold reduction pressure on the strip as it passes between the work rolls, utilizing a running metal strip gripping means to apply back tensioning force to the running metal strip at a point ahead of the first mill stand while maintaining the accumulated running metal strip under the high speed strip handling tension, the back tensioning force applied to the running metal strip by the running metal strip gripping means at the point ahead of the first cold reduction mill stand being great enough to cause metal strip elongation in the running metal strip passing between the work rolls of the first cold reduction mill stand, and while applying the back tensioning force to the running metal strip at the point ahead of the first cold reduction mill stand simultaneously applying lateral force to the running metal strip by pivoting the running metal strip gripping means in a horizontal plane when necessary in the direction and to such extent as to assure that the center line of the running metal strip coincides with the center line of the first cold reduction mill stand.

* * * * *

UNITED STATES PATENT AND TRADEMARK OFFICE

CERTIFICATE OF CORRECTION

PATENT NO. : 4,179,913

DATED : Dec. 25, 1979

INVENTOR(S) : Judson W. Martt

It is certified that error appears in the above–identified patent and that said Letters Patent are hereby corrected as shown below:

Col. 5, line 52, "of" should be -- in --;

Col. 7, line 19, after "lug" insert -- 117 --;

Col. 9, line 11, "50[" should be -- 50" --.

Signed and Sealed this

*First* Day of *April 1980*

[SEAL]

*Attest:*

SIDNEY A. DIAMOND

*Attesting Officer*

*Commissioner of Patents and Trademarks*